US005582512A

United States Patent [19]

Bush

[11] Patent Number: 5,582,512

[45] Date of Patent: Dec. 10, 1996

[54] COMPACT OLDHAM COUPLING

[75] Inventor: James W. Bush, Skaneateles, N.Y.

[73] Assignee: Carrier Corporation, Syracuse, N.Y.

[21] Appl. No.: 499,464

[22] Filed: Jul. 7, 1995

[51] Int. Cl.[6] ..... F01C 1/04

[52] U.S. Cl. ..... 418/55.3; 464/102

[58] Field of Search ..... 418/55.1, 55.3; 464/102, 104

[56] References Cited

U.S. PATENT DOCUMENTS 5,281,114 1/1994 Bush ..... 418/55.3

5,538,408 7/1996 Blass et al. ..... 464/102

FOREIGN PATENT DOCUMENTS 3267501 11/1991 Japan ..... 418/55.3

*Primary Examiner*—Charles G. Freay

[57] ABSTRACT

A compact Oldham coupling has an inner surface defined by two sections of a circle joined by a pair of chords with an outer surface defined by three circular sections located radially outward of each of the two sections of a circle. The center portion of the three circular sections has the same center as the two sections of a circle such that the central portions of the coupling are of uniform radial thickness and the adjacent curved sections are of varying radial thickness.

12 Claims, 3 Drawing Sheets

COMPACT OLDHAM COUPLING

BACKGROUND OF THE INVENTION

An Oldham coupling is a device in which two reciprocating motions at right angles permit an orbiting motion between two members coacting with the Oldham coupling. Basically, the Oldham coupling reciprocates sinusoidally relative to a first member while a second member reciprocates cosinusoidally relative to the Oldham coupling in a direction perpendicular to the direction of movement of the Oldham coupling. In this manner the second member goes through a circular orbiting motion with no relative rotation. Assuming that the Oldham coupling is circular, which is a common shape but not required for proper function, the outside clearance required for its movement is of an oval or racetrack shape, specifically two semicircles joined by a straight section. The inside clearance required for its movement consists of two intersecting circular arcs, each of equal radius and less that 180° in extent, and with the axis joining the two points of intersection being perpendicular to the axis of travel of the Oldham coupling. As noted, the Oldham coupling is located between two members so that any supporting structure between the two members must pass through the plane of movement of the Oldham coupling. In devices such as scroll compressors which are typically located in cylindrical shells, the clearance needed for travel of the Oldham coupling may dictate the need for a larger diameter shell than would otherwise be the case. Assuming a cylindrical shell, most of the available space for the inner or outer support structure is in a direction perpendicular to the direction of travel of the Oldham coupling. Given the fact that at least some of the supporting structure needs to be located outside of the space required for movement of the Oldham coupling, the minimum enclosing shell diameter will be determined by a combination of the size of the inner supporting structure, the radial width of the Oldham coupling, the space required for the coupling's motion, and the size of the outer supporting structure. Since the inner support structure is typically round due to manufacturing considerations, there is some space available outside the inner support structure in a direction perpendicular to the direction of travel of the coupling which is essentially unavailable and is thus wasted. Reducing the radial thickness of the curved portions of the ring or outer support structure provides only a limited opportunity to reduce the shell diameter before structural integrity considerations arise.

SUMMARY OF THE INVENTION

An Oldham coupling is in the form of an oval ring made up of a plurality of distinct portions on the outer surface, at least some of which are curved, and a pair of curved and a pair of straight portions on the inner surface. Depending upon the specific design details, the inner surface may approach or actually be a complete circle. As disclosed, the outer surface also includes a pair of straight portions but they are just incidental rather than a necessary part of the design and are generally dictated by the corresponding inner surface and structure necessary for locating and supporting the keys. The two straight portions of the inner surface are parallel to the direction of travel of the Oldham coupling and spaced apart by at least a distance corresponding to the diameter of a member which it surrounds plus a clearance. The curved portions of the inner surface are circular arcs having a common center in the center of the opening and having a diameter at least equal to the diameter of a member which it surrounds plus the total distance through which the ring travels and a clearance. When the inner surface is not a complete circle, chords drawn through the ends of each curved portion will be spaced from the center which is common to both curves. This should be contrasted with U.S. Pat. No. 4,992,033 which has separate centers for each semicircular curve spaced by a distance corresponding to the length of the straight portion and in which the chord drawn through the ends of each curved portion corresponds to a diameter of each portion which passes through its respective center. The larger radius of the curved portion of the present invention results in a "straighter" curved portion for a given chord length in that the maximum distance between the chord and the curve decreases with an increase in radius. The outer surface incidentally has two straight portions radially spaced from and parallel to the inner straight portions.

Corresponding ends of the two outer straight portions are connected by curved portions made up of three segments with a transition between each pair of adjacent segments. The central segments of the curved portions are preferably arcs centered at the center of the curved portions of the inner surface, the outer segments of the curved portions are preferably symmetrical with the axis of movement of the Oldham coupling and have a radius greater than that of the central segment but have a center on the axis of movement of the Oldham coupling and at a distance from the center of the central portion which is about the same as half of the total travel of the Oldham coupling and which is positioned on the opposite side of the center of the central portion. Accordingly, the thickness of the ring at the transition between the outer and central curved portions reduces with the reduction in the length of the central curved segments. The transition between the curved segments represents the thinnest portion of the ring and therefore determines its structural integrity. Additionally, the outer curved portion and the transition serve as a recess for accommodating a structural support member.

It is an object of this invention to reduce the required operating space for an Oldham coupling.

It is another object of this invention to add some material to the inner contour of an essentially round Oldham coupling to structurally reinforce the ring which will then allow the removal of material from the outer contour to provide space for an outer structural support member to be moved radially inward, thus reducing the required diameter for an enclosing shell. These objects, and others as will become apparent hereinafter, are accomplished by the present inventions.

Basically, the compact Oldham coupling has an inner surface defined by two sections of a circle on a common center joined by a pair of chords with an outer surface defined by three circular sections located radially outward of each of the two sections of a circle with the central portions having the same center as the two sections of a circle such that the central portions of the coupling are of uniform radial thickness and the adjacent curved sections are of varying radial thickness.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
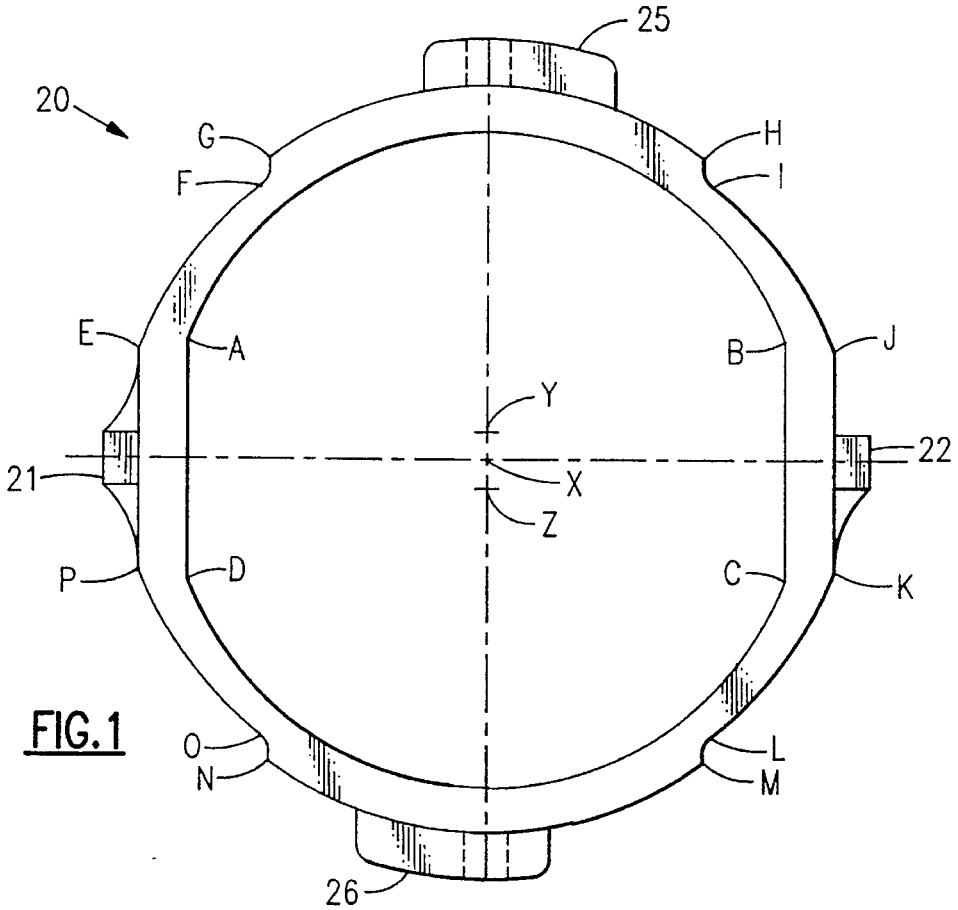
FIG. 1 is a top view of an Oldham coupling made according to the teachings of the present invention.

In FIG. 1, the numeral 20 generally designates an Oldham coupling. The interior surface of coupling 20 is made up of two circular arcs AB and CD which have a center X with the ends of the arcs joined by chords BC and AD. The outer surface of coupling 20 corresponding to arc AB is serially made up of arc EF, transition FG, arc GH, transition HI and arc IJ. Similarly, the outer surface corresponding to arc CD is serially made up of arc KL, transition LM, arc MN, transition NO and arc OP. Arcs GH and MN, like arcs AB and CD, have X as a center and therefore coact therewith to define two arcuate portions having a uniform radial thickness. Arcs GH and MN are circular only through convenience as opposed to being a specific design requirement. For example, they could be modified to accommodate support structure or the like. Point Z is the center for arcs EF and IJ which connect to arc GH through transitions FG and HI, respectively. Similarly, point Y is the center for arcs KL and OP which connect to arc MN through transitions LM and NO, respectively. The distances between point X and points Y and Z, respectively, is equal to the radius of orbit of the orbiting scroll 30, a portion of which appears as a cylindrical hub in FIGS. 2–4. Because circular arcs EF and IJ have a different center than circular arc AB and because circular arcs KL and OP have a different center than circular arc CD, they define therebetween sections having a varying radial thickness. The ends of arcs EF and OP are connected through straight section EP and, similarly, the ends of arcs IJ and KL are connected through straight section JK. The straight sections EP and JK are straight only through convenience as opposed to being a specific design requirement. As is conventional, coupling 20 has two pairs of keys with keys 21 and 22, which coact with orbiting scroll 30, being visible in FIG. 1 and the other keys being shown in phantom on webs 25 and 26, respectively.

Figure 2:
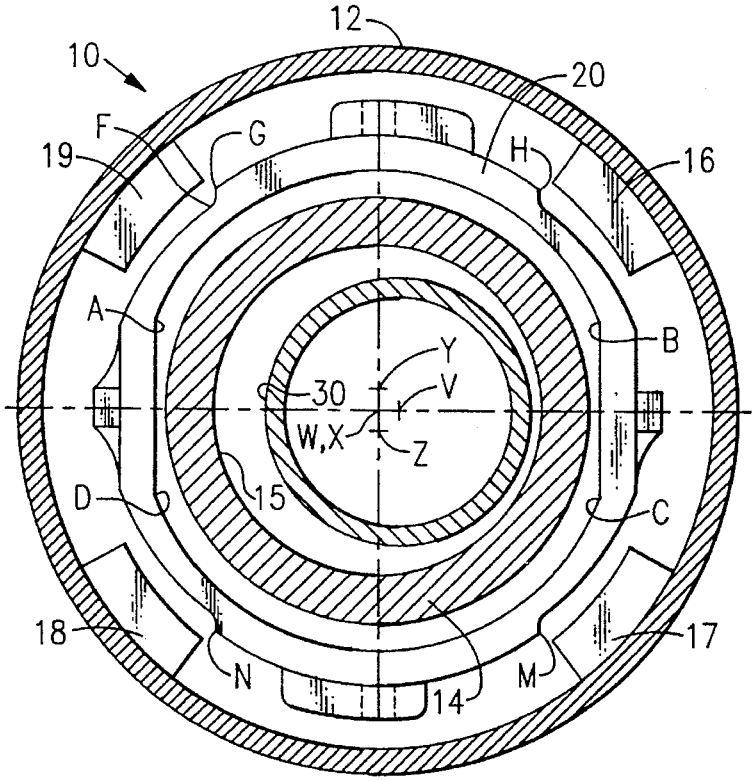
FIG. 2 is a sectional view of a scroll compressor employing the Oldham coupling of the present invention with the coupling being in a central position.
Figure 3:
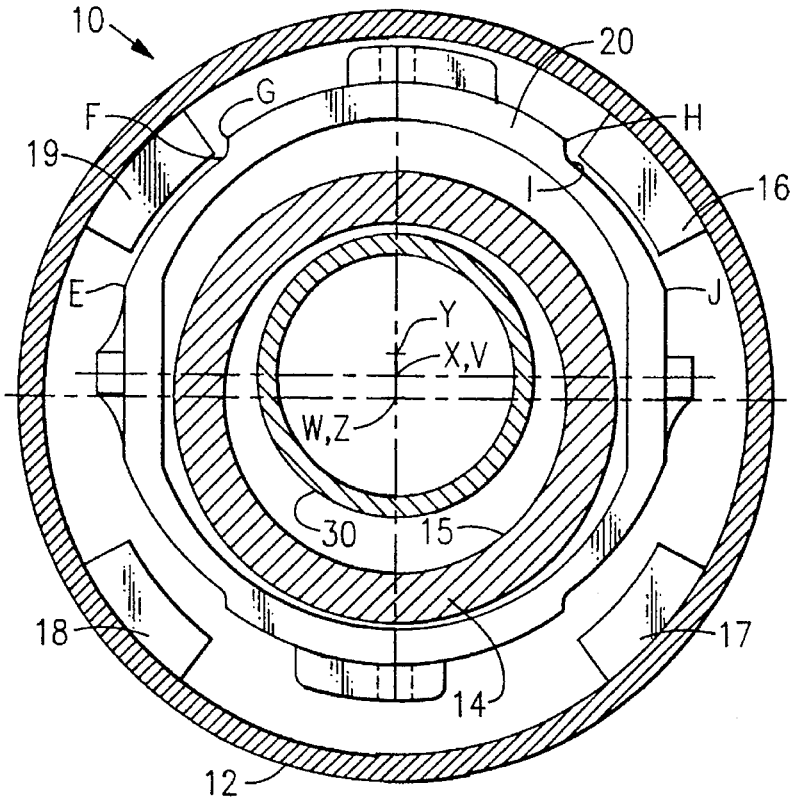
FIGS. 3 and 4 correspond to FIG. 2 but show the two extremes of movement of the Oldham coupling.
Figure 4:
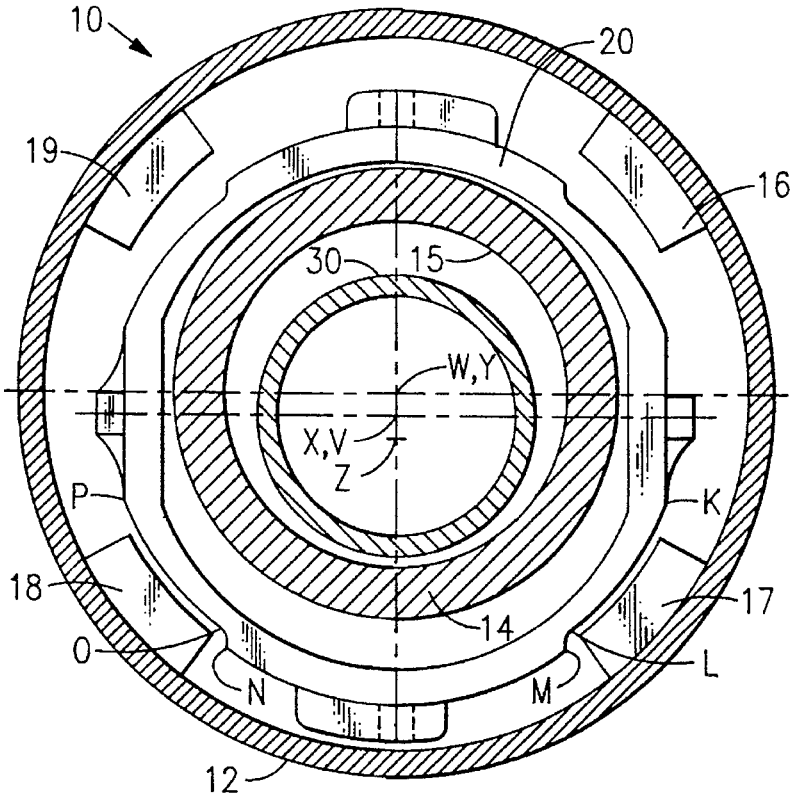

In FIGS. 2–4, Oldham coupling 20 is shown located in scroll compressor 10 which has a cylindrical shell 12 with an axis represented by point W. Coupling 20 surrounds inner support member or thrust surface 14 and is movable over the illustrated range of movement while always maintaining an operating clearance with the surrounded and surrounding structure. Structural support members 16 through 19 are secured to shell 12 and surround coupling 20 and have inner surfaces forming circular arcs with W as the center for the circle. It will be noted that straight sections BC and DA are separated by the diameter of thrust surface or support member 14 plus clearances while the diametrical distance between arcs AB and CD is the diameter of the thrust surface or support member 14 plus the diameter of orbit for the orbiting scroll 30 plus clearances. As noted above, orbiting scroll 30 only appears as a cylindrical hub with a center V and which orbits within opening 15 in thrust surface 14. Orbiting scroll 30 coacts with keys 21 and 22 of Oldham coupling 20 and reciprocates, relative to Oldham coupling 20, along a line defined by keys 21 and 22. Referring specifically to FIG. 2 it will be noted that orbiting scroll 30 is at an extreme limit of travel, to the right, along the line defined by keys 21 and 22 and coupling 20 is centrally located such that the axes represented by points W and X are coaxial. Accordingly, common point W, X is the center for the arcs AB, CD, GH, MN and the inner surfaces of supports 16 through 19. The operating clearances in the FIG. 2 position are between the inner support 14 and the straight sections BC and DA, as would also be true of all other positions of coupling 20.

In FIG. 3, orbiting scroll 30 has progressed 90° counterclockwise, relative to the FIG. 2 position, to a central position along the line defined by keys 21 and 22. Additionally, coupling 20 has moved to one extreme position where the axes represented by points W and Z are coaxial. Accordingly, common point W, Z is the center for the arcs EF and IJ as well as the inner surfaces of supports 16 through 19 with supports 19 and 16 being separated from arcs EF and IJ, respectively, by their operating clearances. It will be noted that transitions FG and HI effectively define notches in coupling 20 for accommodating supports 19 and 16, respectively, thereby permitting a greater movement of coupling 20 in the given envelope than if the outer section of the coupling extending between points E to J had been defined by a single arc centered at X and having the same radius as section GH, as in a more conventional circular coupling.

In FIG. 4, orbiting scroll 30 has progressed an additional 180° relative to the Figure 3 position to again be in a central position along the line defined by keys 21 and 22 and coupling 20 has moved to the other extreme position where the axis represented by points W and Y are coaxial. Accordingly, common point W, Y is the center for the arcs KL and OP as well as the inner surfaces of supports 16 through 19 with supports 17 and 18 being separated from arcs KL and OP, respectively, by their operating clearances. It will be noted that transitions LM and NO effectively define notches in coupling 20 for accommodating supports 17 and 18, respectively, thereby permitting a greater movement of coupling 20 in the given envelope than if the outer section of the coupling extending between points K to P had been defined by a single arc centered at X and having the same radius as section MN, as in a more conventional circular coupling.

Figure 5:
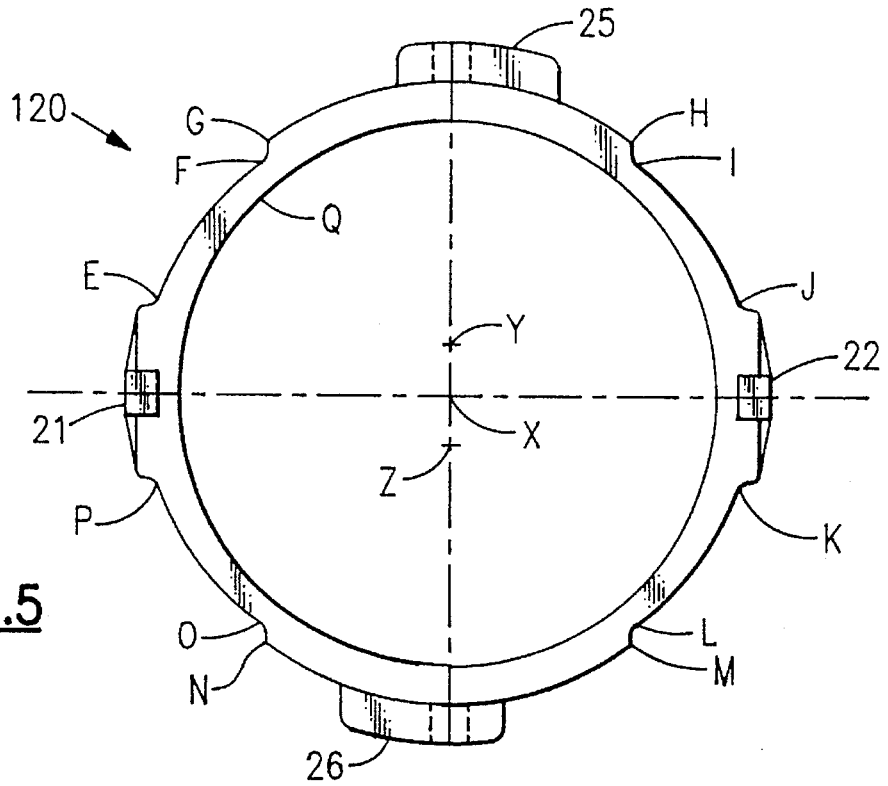
FIG. 5 is a top view of a modified Oldham coupling.
Figure 6:
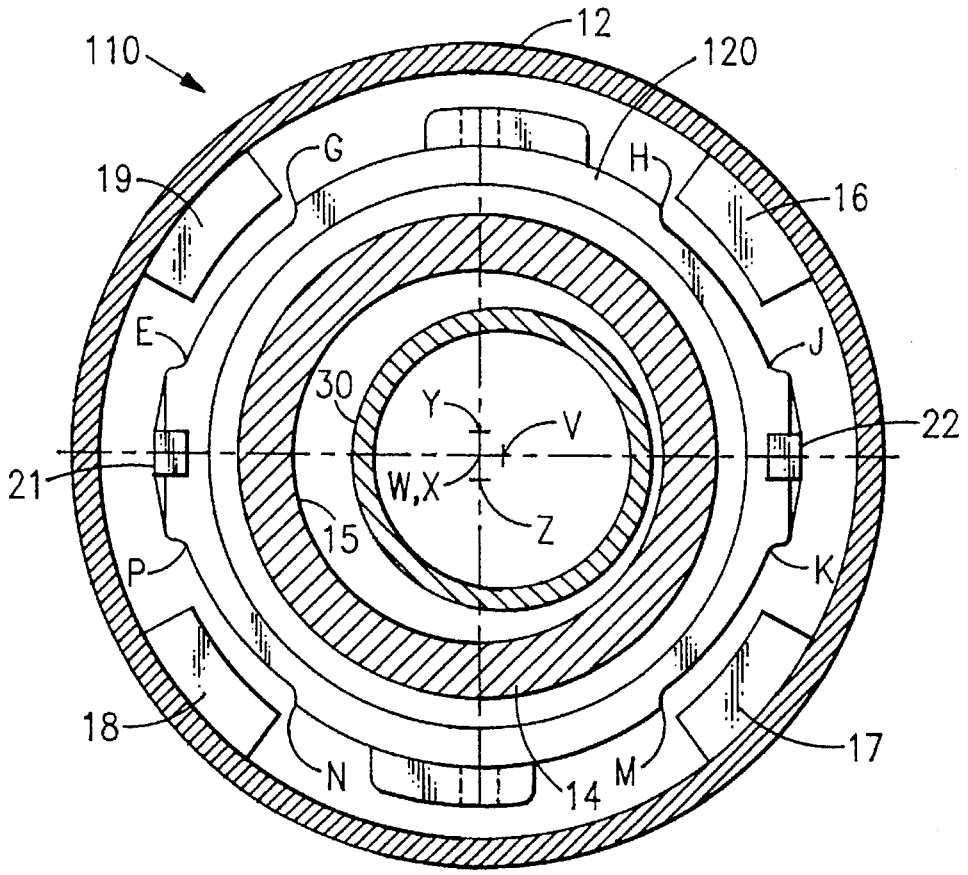
FIG. 6 illustrates the coupling of FIG. 5 in a position corresponding to that shown in FIG. 2.

Referring now to FIG. 5, Oldham coupling 120 differs from coupling 20 in that circular arcs AB and CD and straight sections AD and BC have been replaced with a circular portion Q. The outer surface defined by points E to P remains the same with the only change relating to adding material between points E and P and points J and K to compensate for material removed between points A and D and Points B and C and the associated modification of the support webbing for keys 21 and 22. In comparing FIGS. 2 and 6, it will be noted that coupling 120 has a larger minimum clearance with support member 14 than does coupling 20. Further, the added material between points E and P and points J and K still maintains a clearance with shell 12. The operation of coupling 120 would be the same as that of coupling 20, with no other modification to the rest of the compressor assembly. Although preferred embodiments of the present invention have been described and illustrated, other changes will occur to those skilled in the art. It is therefore intended that the scope of the present invention is to be limited only by the scope of the appended claims.

What is claimed is:

1. In a scroll compressor having a generally cylindrical shell having an axis, a plurality of circumferentially spaced support members secured to said shell and having inner surfaces forming portions of a cylindrical surface centered on said axis of said shell, an Oldham coupling located in said shell and reciprocatably located with respect to said shell in a plane transverse to said axis of said shell, an orbiting scroll coacting with said coupling so as to orbit at a distance defining an orbiting radius with respect to said axis of said shell, said coupling being movable in said shell over a distance twice that of said orbiting radius and characterized by:

an axis;

an inner surface and a radially spaced outer surface;

said inner surface being defined by two sections of a circle which are less than 180° in extent and which are joined by a pair of chords;

said outer surface including three sections located radially outward of each of said two sections of a circle defining said inner surface;

said three sections each having a central portion and a pair of side portions; and each pair of said side portions being circular sections having a common center which is located a distance equal to said orbiting radius beyond said axis of said coupling.

2. The coupling of claim 1 wherein there is a radially inward extending transition between each end of said central portions and corresponding ones of said side portions.

3. The coupling of claim 1 wherein said side portions have a radius corresponding to that of said cylindrical surface centered on said axis of said shell less an amount equal to a working clearance.

4. The coupling of claim 1 wherein said central portions extend between adjacent ones of said circumferentially spaced support members when said coupling is at extremes of travel.

5. The coupling of claim 4 wherein said side portions face corresponding ones of said circumferentially spaced support members when said coupling is at extremes of travel.

6. The coupling of claim 1 wherein said central portions are circular segments having a common center with said two sections of a circle defining said inner surface.

7. In a scroll compressor having a generally cylindrical shell having an axis, a plurality of circumferentially spaced support members secured to said shell and having inner surfaces forming portions of a cylindrical surface centered on said axis of said shell, an Oldham coupling located in said shell and reciprocatably located with respect to said shell in a plane transverse to said axis of said shell, an orbiting scroll coacting with said coupling so as to orbit at a distance defining an orbiting radius with respect to said axis of said shell, said coupling being movable in said shell over a distance twice that of said orbiting radius and characterized by:

an axis;

an inner surface and a radially spaced outer surface;

said inner surface being defined by a circle;

said outer surface including a pair of segments each including three sections located radially outward of said circle defining said inner surface;

said three sections each having a central portion and a pair of side portions; and each pair of said side portions being circular sections having a common center which is located a distance equal to said orbiting radius beyond said axis of said coupling.

8. The coupling of claim 7 wherein there is a radially inward extending transition between each end of said central portions and corresponding ones of said side portions.

9. The coupling of claim 7 wherein said side portions have a radius corresponding to that of said cylindrical surface centered on said axis of said shell less an amount equal to a working clearance.

10. The coupling of claim 7 wherein said central portions extend between adjacent ones of said circumferentially spaced support members when said coupling is at extremes of travel.

11. The coupling of claim 10 wherein said side portions face corresponding ones of said circumferentially spaced support members when said coupling is at extremes of travel.

12. The coupling of claim 7 wherein said central portions are circular segments having a common center with said circle defining said inner surface.

* * * * *